US005823465A

United States Patent [19]

Marangoni

[11] Patent Number: 5,823,465

[45] Date of Patent: Oct. 20, 1998

[54] METALLIC SPOOL

[75] Inventor: Gianluigi Marangoni, Vicenza, Italy

[73] Assignee: GIMAX S.R.L., Sovizzo, Italy

[21] Appl. No.: 677,487

[22] Filed: Jul. 9, 1996

[51] Int. Cl.[6] ..... B65H 75/20

[52] U.S. Cl. ..... 242/604.1

[58] Field of Search ..... 242/604.1, 604, 242/407, 118.7, 118.1, 118.4

[56] References Cited

U.S. PATENT DOCUMENTS

| | | | |
|---|---|---|---|
| 2,973,915 | 3/1961 | Elow | 242/604.1 |
| 4,032,078 | 6/1977 | Van De Loock | 242/604.1 |
| 4,570,871 | 2/1986 | Compagnucci | 242/604.1 |
| 4,679,746 | 7/1987 | Compagnucci et al. | 242/604.1 |
| 4,819,888 | 4/1989 | Masera | 242/604.1 |
| 5,197,689 | 3/1993 | Barone | 242/118.7 |

FOREIGN PATENT DOCUMENTS

| | | | |
|---|---|---|---|
| 2037945 | 7/1980 | United Kingdom | 242/604.1 |

*Primary Examiner*—John M. Jillions
*Attorney, Agent, or Firm*—Bucknam and Archer

[57] ABSTRACT

The metallic spool used for winding in a skein flexible products in the form of a wire, of the type constituted by a structure (1) composed of two rings (2) which are parallel and concentric. The spool is characterized by the fact that all the components of the spool are made with a single type of metallic wire and further components (2), (3) and (5) have a particular conformation.

6 Claims, 2 Drawing Sheets

METALLIC SPOOL

FIELD OF THE INVENTION

The present invention relates to the construction of a metallic spool according to the general part of claim 1.

BACKGROUND OF THE PRIOR ART

In industrial operations there is the necessity of having some products wound as a skein on particular supports which are called reels. When the products to be wound are metallic wires, the reel which in this particular application takes the name of a spool, must have a strong structure and at the same time, should not be very heavy so that the supports should not be particularly bulky and also should have a limited production cost because these spools are disposed of after use.

This necessity is particularly required in the field of industrial apparatuses for electrical welding of the type MIG-TIG and having a submersed arch in which skeins of steel, aluminum, etc., wire are required in proximity of the area of operation in order to carry out welding with weld material.

According to the present state of operation, there are many different types of spools, both of plastic material and metallic material, capable of being mounted on welding apparatuses which may be portable or fixed and the spools are constituted essentially by a central hub on which the wire is being wound and two lateral bands which hold the skein, which is formed with the winding action.

SUMMARY OF THE INVENTION

The present invention resides in a particular form of construction of a metallic spool which has advantages from the point of view of the construction, the resistance and the cost with respect to similar products which are presently found in the market.

This novel spool is characterized by the fact that it is constructed of a single type of metallic wire always of the same diameter and is composed of a plurality of shaped structures according only to three shapes, these structures being soldered reciprocally in order to constitute the final article. In particular, the spool according to the present invention is made with a single type of metallic wire, of a few millimeters in diameter and is constituted by two parallel and concentric rings which constitute the external border of the two lateral bands, and the two rings are kept spaced one from the other by a plurality of shaped sections in the shape of a "C", the sections having the same shape. These sections constitute a recess for containing and supporting the skein of the wound product. The spool according to the invention also comprises four central structures which have the same shape and which constitute the central hub used to hook with the working apparatus.

According to a further embodiment of the invention, the hub is constituted by eight central structures reciprocally placed one next to the other and all of them having the same shape.

The object of this further feature is to make the central portion more resistant because the number of radial sections which support the hub is doubled.

A further feature of the invention resides in the fact that the shaped sections in the shape of a "C" and the central structures are provided at their ends with folded extensions, the extensions being made with the same metallic wire of the section or central structures of which they are the extensions.

The direction of folding of the extensions is simultaneously perpendicular to the portion of the section or structure of which they are the extension and parallel to the portion of the section or structure on which the extension is going to be joined in a stable manner by soldering. In particular, the extensions shaped as a "C", in addition to being perpendicular to the shape of the "C", are also folded with a radius equal to the internal radius of the rings which constitute the external border of the lateral bands to which the shaped sections are to be united in a stable manner.

The advantage which is derived by the introduction of the folded extensions described hereinabove resides in the possibility of carrying out the soldering operation, not only in a single point, but on an extension equal to the length of the extension so that the same operation is made easier and at the same time there is also a greater strength in the entire metallic spool.

Finally, the invention resides in the fact that the folded extensions of the shaped sections in the form of a "C" which are placed in contact with the ring which constitutes the external border of the spool are soldered in such a manner that at the end of the same operation they are slightly inclined towards the exterior of the spool in order to avoid any interference with the winding of the wire in the recess in which the skein is contained.

These and other features of the invention will be better appreciated by the description of a particular embodiment which is provided merely by way of an example and is not limiting, and by reference to the accompanying drawings, of which:

Figure 1:
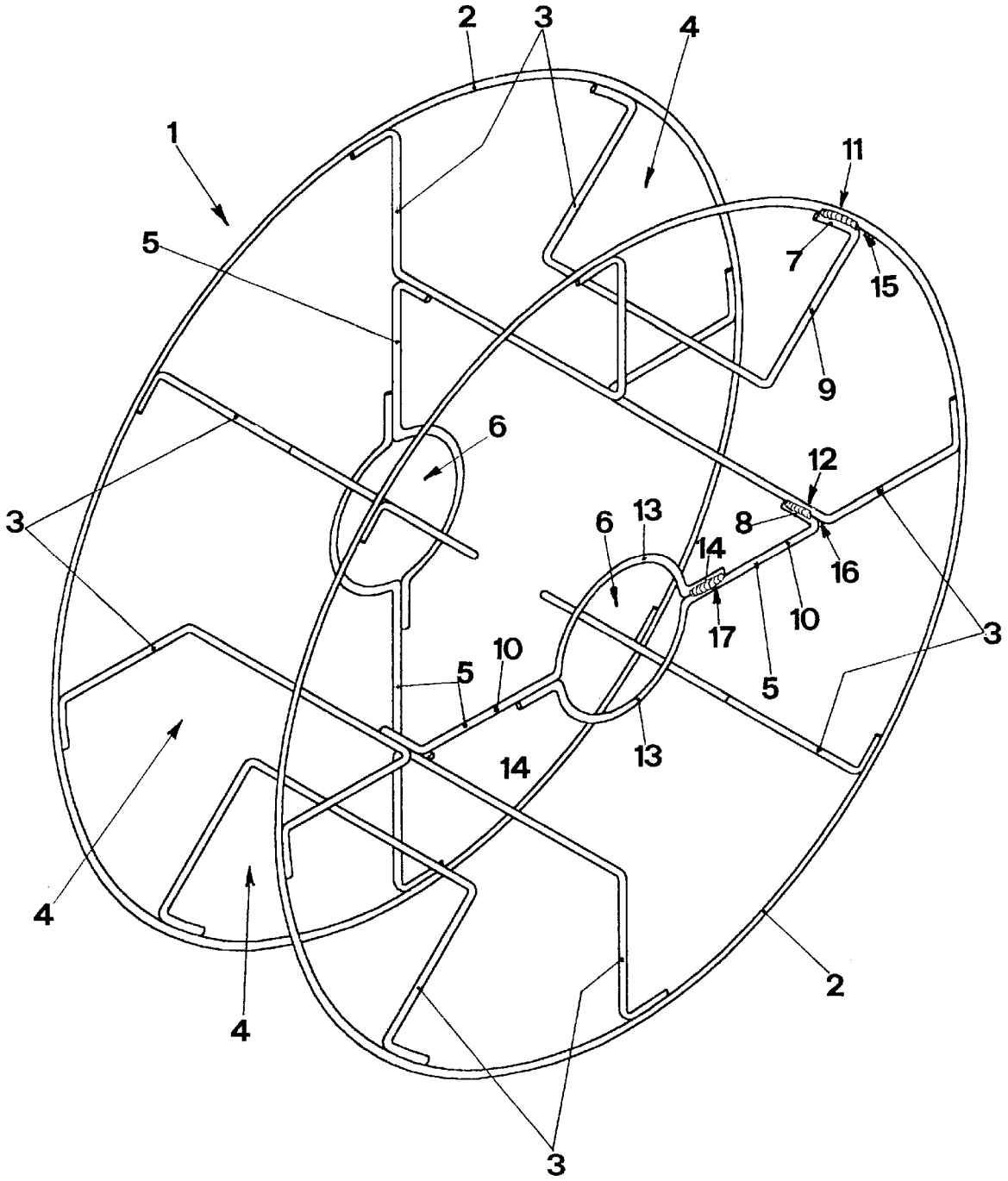
FIG. 1 is a perspective view of the spool of the invention having the hub constituted by four central structures.

As shown in FIG. 1, the metallic spool (1) made with a metallic wire of the same diameter is constituted by two rings (2) which are parallel and concentric and which constitute the external border of the lateral bands of the spool. The two rings are kept spaced from each other by means of eight sections (3) shaped as a "C" all of them having the same shape. These sections constitute the recess (4) which has the purpose of containing and supporting the skein of the wound product. In addition, there are four central structures (5) which are divided in two pairs rotating by 90° and reciprocally symmetrical. These structures (5) have the same shape and constitute the central hub (6) which is used to hook up with the operating apparatus.

The shaped section (3) and the central structures (5) are provided at their ends with folded extensions (7) and (8) made with the same metallic wire as the sections (3) and the structures (5).

These folded extensions (7) and (8) are simultaneously perpendicular to the portion of the sections (3) and the structures (5) of which they are the extension, respectively portion (9) of section (3) and portion (10) of the central structure (5) and are also parallel to the section of the member on which these extensions are to be welded respectively, specifically the portion (11) of the external ring (2) and portion (12) of the shaped section (3). In particular, the folded extension (7) of the shaped section (3) is curved with a radius of curvature equal to the internal radius of the portion (11) of the external ring (2).

In addition, the folded extension (7) must be slightly inclined towards the exterior of the spool at the end of the welding operation of the spool (1).

The two structures (5) which are reciprocally joined and which form one of the two pairs which constitute the hub (6), have the extremity curved to form a semi-circle (13). This extremity is provided with a parallel extension (14) and is in contact with the portion (10) of the opposite structure (5).

Finally, the welding between the several members (2), (3) and (5) which constitute the entire spool (1) is carried out on an extension respectively (15), (16) and (17) equal to the length of the extensions respectively (7), (8) and (14).

Figure 2:
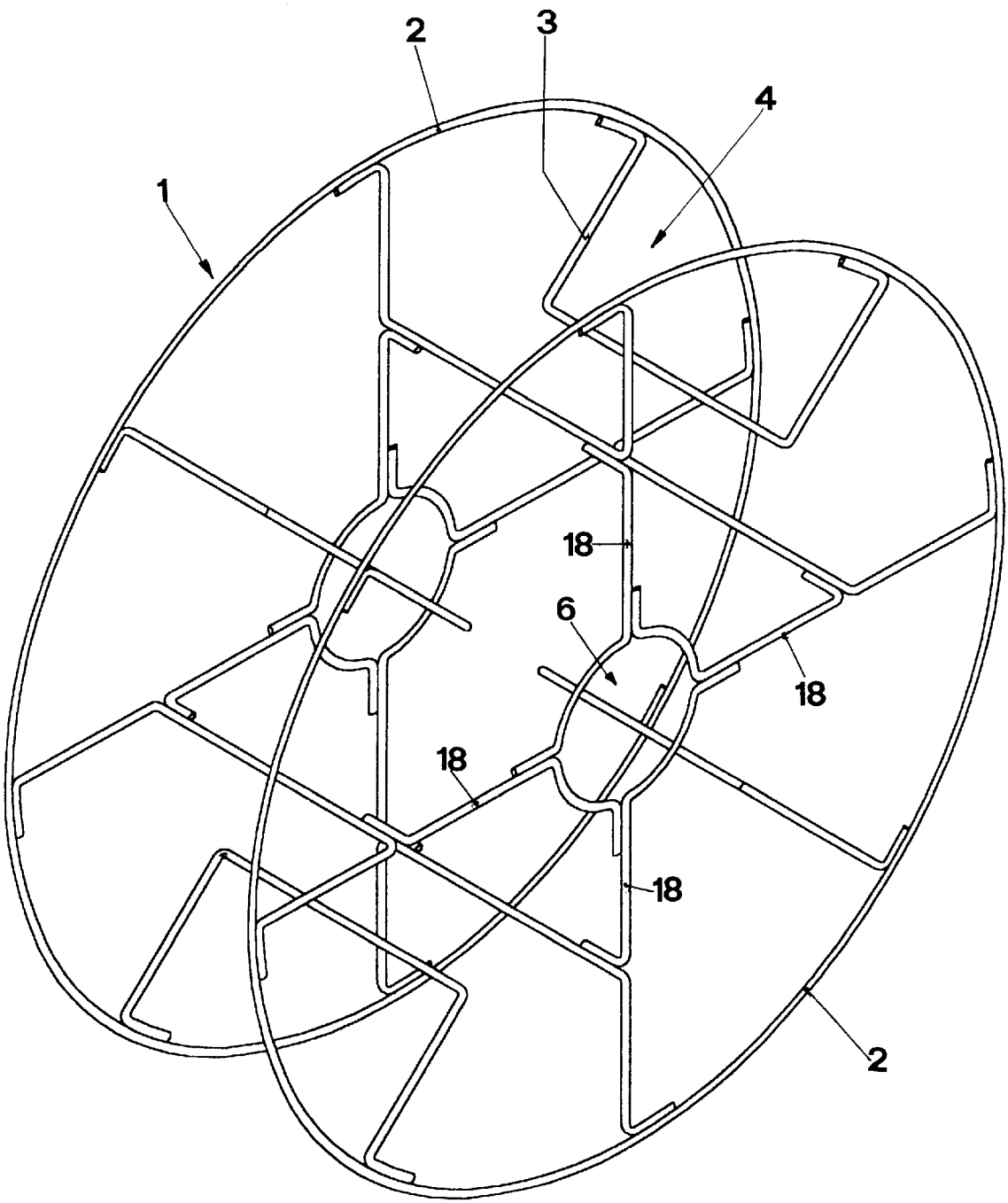
FIG. 2 is a perspective view of the spool of the invention with the hub being constituted by eight central structures.

FIG. 2 shows an embodiment of the spool (1) in which the hub (6) is constituted by eight central members (18) divided on two symmetrical pairs.

What is claimed is:

1. A metallic spool (1) for winding filiform flexible materials in the form of a skein to form a wound product, said spool having lateral bands and being constituted by a structure (1), said structure (1) being composed of two rings (2), said rings (2) being parallel and concentric and constituting the external border of the lateral bands of said spool, one of said rings being the external ring, said rings being held spaced by a plurality of sections (3), said sections (3) being shaped in the form of a "C", said sections constituting the recess (4) for containing and supporting said skein of said wound product and being held spaced also by a plurality of central structures (5) (18), said structures (5) constituting the central hub (6) for hooking with the operating machine, wherein said rings (2), said sections (3) and said central structures (5) are made of a single type of metallic wire, said sections (3) and said central structures (5) are provided at the extremities thereof with extensions (7) and (8), said extensions being folded, said extensions (7) and (8) being made of the same metallic wire of said spool, said sections (3) having extensions (9) and said structures (5) having extensions (10), said folded extensions (7) and (8) being simultaneously perpendicular to said extensions (9) of said section (3) and to said extensions (10) of said central structures (5), said external ring (2) having a portion (11) and said shaped sections (3) having portion (12), said extensions (7) and (8) being parallel, respectively to said portion (11) of said external ring (2) and to said portion (12) of said section (3).

2. The metallic spool according to claim 1, wherein said spool has an exterior, said portion (11) of said external ring (2) has an internal radius, said extension (7) of said shaped section (3) is curved with a radius of curvature equal to said internal radius of said portion (11) of said ring (2), said extension (7) after the welding operation of said spool (1), being slightly inclined towards said exterior of said spool.

3. The metallic spool according to claim 1, wherein said central hub is constituted by four central structures (5), said structures (5) forming two pairs, said structures (5) have the extremity thereof curved to form a semi-circle (13), each of said extremities being provided with an extension (14), said extension being parallel and in contact with said portion (10) of the opposite central structure (5).

4. The metallic spool according to claim 3, wherein said extensions (7) (8) and said rings (2), said section (3) and said central structures (5) which constitute said spool are welded to each other and the welding is carried out on extensions (15), (16) and (17), said extensions being equal to the length of said extensions (7), (8) and (14).

5. The metallic spool according to claim 1, wherein said central structures (5) are four in number, said central structures (5) being divided into two pairs, said pairs being rotated by an angle of 90° whereby they are out of phase by an angle of 90° with respect to each other.

6. The metallic spool according to claim 1, wherein said central structures (18) are eight in number, said central structures (18) forming two pairs, said two pairs being welded symmetrical with respect to each other.

* * * * *